US012611566B2

(12) United States Patent
Lee

(10) Patent No.: US 12,611,566 B2
(45) Date of Patent: Apr. 28, 2026

(54) SMART TORQUE SIMULATION DEVICE

(71) Applicant: CHI HUA FITNESS CO., LTD., Hsinchu County (TW)

(72) Inventor: Chia Jung Lee, Hsinchu County (TW)

(73) Assignee: CHI HUA FITNESS CO., LTD., Hsinchu County (TW)

( * ) Notice: Subject to any disclaimer, the term of this patent is extended or adjusted under 35 U.S.C. 154(b) by 465 days.

(21) Appl. No.: 18/347,836

(22) Filed: Jul. 6, 2023

(65) Prior Publication Data

US 2025/0010127 A1 Jan. 9, 2025

(51) Int. Cl.

| | |
|---|---|
| ***A63B 21/22*** | (2006.01) |
| ***A63B 21/00*** | (2006.01) |
| ***A63B 24/00*** | (2006.01) |

(52) U.S. Cl.

CPC ..... *A63B 21/225* (2013.01); *A63B 21/00192* (2013.01); *A63B 24/0087* (2013.01); *A63B 2209/08* (2013.01)

(58) Field of Classification Search

CPC ..... A63B 21/225; A63B 21/00192; A63B 24/0087; A63B 2209/08; A63B 2225/50; A63B 71/0622; A63B 21/0051; A63B 21/0058; A63B 2220/54; A63B 21/005; H02K 16/00; H02K 16/02; H02K 21/022; H02K 21/023; H02K 21/024; H02K 21/025; H02K 21/028; H02K 21/10; H02K 21/12; H02K 21/125; H02K 21/22; H02K 21/222; H02K 21/227; H02K 21/24; H02K 21/26; H02K 21/28; H02K 23/60; H02K 23/62; H02K 7/02; H02K 7/025; H02K 21/00; H02K 23/56; Y02E 60/16

See application file for complete search history.

(56) References Cited

U.S. PATENT DOCUMENTS

| | | | | |
|---|---|---|---|---|
| 2017/0047870 | A1* | 2/2017 | Lee | H02K 1/06 |
| 2025/0025734 | A1* | 1/2025 | Zhao | G01M 99/00 |
| 2025/0161735 | A1* | 5/2025 | Mehtälä | A63B 21/153 |

* cited by examiner

*Primary Examiner* — Loan B Jimenez
*Assistant Examiner* — Jacqueline N L Loberiza
(74) *Attorney, Agent, or Firm* — Birch, Stewart, Kolasch & Birch, LLP

(57) ABSTRACT

The smart torque simulation device includes: a bracket; a shaft center; a winding wheel which having a winding wheel spinning encoder; an outer flywheel which an outer flywheel spinning encoder, the winding wheel and the outer flywheel are relatively coupled with a magnetic plate and a magnet; an inner flywheel with a field magnet, the inner flywheel has a power transmission relationship with the outer flywheel; a coil set, having a coil fixing frame which has an armature coil, and the armature coil is coupled to the field magnet of the inner flywheel, the armature coil has an electric current regulator; and a control system, receiving a winding wheel spinning data from the winding wheel spinning encoder and receiving an outer flywheel spinning data from the outer flywheel spinning encoder, and then sending an armature electric current control data to the electric current regulator.

4 Claims, 9 Drawing Sheets

SMART TORQUE SIMULATION DEVICE

BACKGROUND OF THE INVENTION

1. Field of the Invention

The invention relates to a smart torque simulation device, especially to one that uses a dual-rotor non-contact torque transmission structure to linearly simulate the motor torque as motion resistance.

2. Description of the Related Art

As showing in FIG. 1, the conventional strength training machine 10 uses the iron weight stack 11 as a load resistance, and allows the user to pull the iron weight stack 11 through the grip bar 12 and the cable 13 to shape healthy muscles, and promote physiological functions and keeping the body healthy; however, the conventional strength training machine has the following shortcomings: 1. The iron weight stack 11 takes up a lot of space, and it is time-consuming and laborious to adjust the load resistance; 2. When the iron weight stack 11 is pulled up by the cable 13 and then put down, it produces loud impact noise; 3. Cannot set the fitness curve to change the load resistance, so the fitness function is limited.

Patent No. TWM697670/U.S. Ser. No. 11/173,343 discloses a "muscle strength training machine", which combines the rope wheel on the output shaft of the deceleration mechanism, so that the torque generated by the motor is directly transmitted to the rope wheel, which belongs to a "contact torque transmission structure" design, but this design has the following deficiencies: 1. It is necessary to use a larger horsepower motor to provide sufficient motion resistance, 2. Adjusting the motor speed cannot linearly adjust the motion resistance.

SUMMARY OF THE INVENTION

It is a primary objective of the present invention to provide a smart torque simulation device that can simulate the motion resistance by controlling the electric current of the armature.

In order to achieve the above objectives, the smart torque simulation device includes: a bracket; a shaft center set through the bracket; a winding wheel set on the shaft center with a wheel cover to form a containing space inside, the winding wheel is winding with a rope, and having a winding wheel spinning encoder relative to winding wheel; an outer flywheel set on the shaft center with a flywheel cover to form a containing space inside, the outer flywheel and the flywheel cover are located inside the winding wheel, let the winding wheel and the outer flywheel be relatively coupled with a magnetic plate and a magnet, and an outer flywheel spinning encoder is arranged relative to the outer flywheel; an inner flywheel set on the shaft center to form a containing space inside, the inner flywheel is arranged inside the outer flywheel, the inner flywheel has a power transmission relationship with the outer flywheel, and inside the inner flywheel is provide with a field magnet; a coil set, having a coil fixing frame on the shaft center and arranged inside the inner flywheel, having an armature coil arranged on the coil fixing frame, and the armature coil is coupled to the field magnet of the inner flywheel, the armature coil has an electric current regulator; and a control system, receiving a winding wheel spinning data from the winding wheel spinning encoder and receiving an outer flywheel spinning data from the outer flywheel spinning encoder, and then sending an armature electric current control data to the electric current regulator.

Also, the control system has a torque data analyzer, a motion data analyzer, a resistance demand setting unit, a torque demand calculation unit, a torque control algorithmic unit and an armature electric current algorithmic unit; the torque data analyzer receives the outer flywheel spinning data from the outer flywheel spinning encoder, and analyzes out an outer flywheel rotational speed data; the motion data analyzer receives the winding wheel spinning data from the winding wheel spinning encoder, and analyzes out a winding wheel steering data, a winding wheel rotational speed data and the rope pulling length data; the torque demand calculation unit receives the outer flywheel rotational speed data from the torque data analyzer, the winding wheel rotational speed data and the rope pulling length data from the motion data analyzer, and a resistance demand data input by the resistance demand setting unit are added to calculate a torque demand data; the torque control algorithmic unit receives the winding wheel steering data from the motion data analyzer and then calculates with the torque demand data from the torque demand calculation unit to get a target electric current data; the armature electric current algorithmic unit receives the winding wheel rotational speed data from the motion data analyzer and then calculates with the target electric current data from the torque control algorithmic unit to get an armature electric current data; the electric current regulator receives the armature electric current data from the armature electric current algorithmic unit to generate a armature electric current control data, so as to control the electric current of the armature coil.

Also, the power transmission relationship between the inner flywheel and the outer flywheel is achieved through an epicyclic gear set, a ring gear is arranged inside the outer flywheel, and a sun gear is arranged outside the inner flywheel, and multiple epicyclic gears are arranged between the ring gear and the sun gear; or the power transmission relationship between the inner flywheel and the outer flywheel is achieved through the tight fit between the inner flywheel and the outer flywheel.

Also, the bracket combines with two side plates and a cover plate, the cover plate has a rope guiding hole, the rope guiding hole has a rope guiding bushing, the rope set through the rope guiding hole and rope guiding bushing then combines to a grip, the magnetic plate is a copper sheet.

Also, the winding wheel spinning encoder has a magnet of winding wheel spinning encoder arranged on the winding wheel, and the side plates of the bracket have a hall device of winding wheel spinning encoder relative the magnet of winding wheel spinning encoder;

the outer flywheel spinning encoder has a magnet of outer flywheel spinning encoder arranged on the flywheel cover, and the armature coil of the coil set have a hall device of outer flywheel spinning encoder relative the m magnet of outer flywheel spinning encoder.

DETAILED DESCRIPTION OF THE PREFERRED EMBODIMENT

Figure 1:
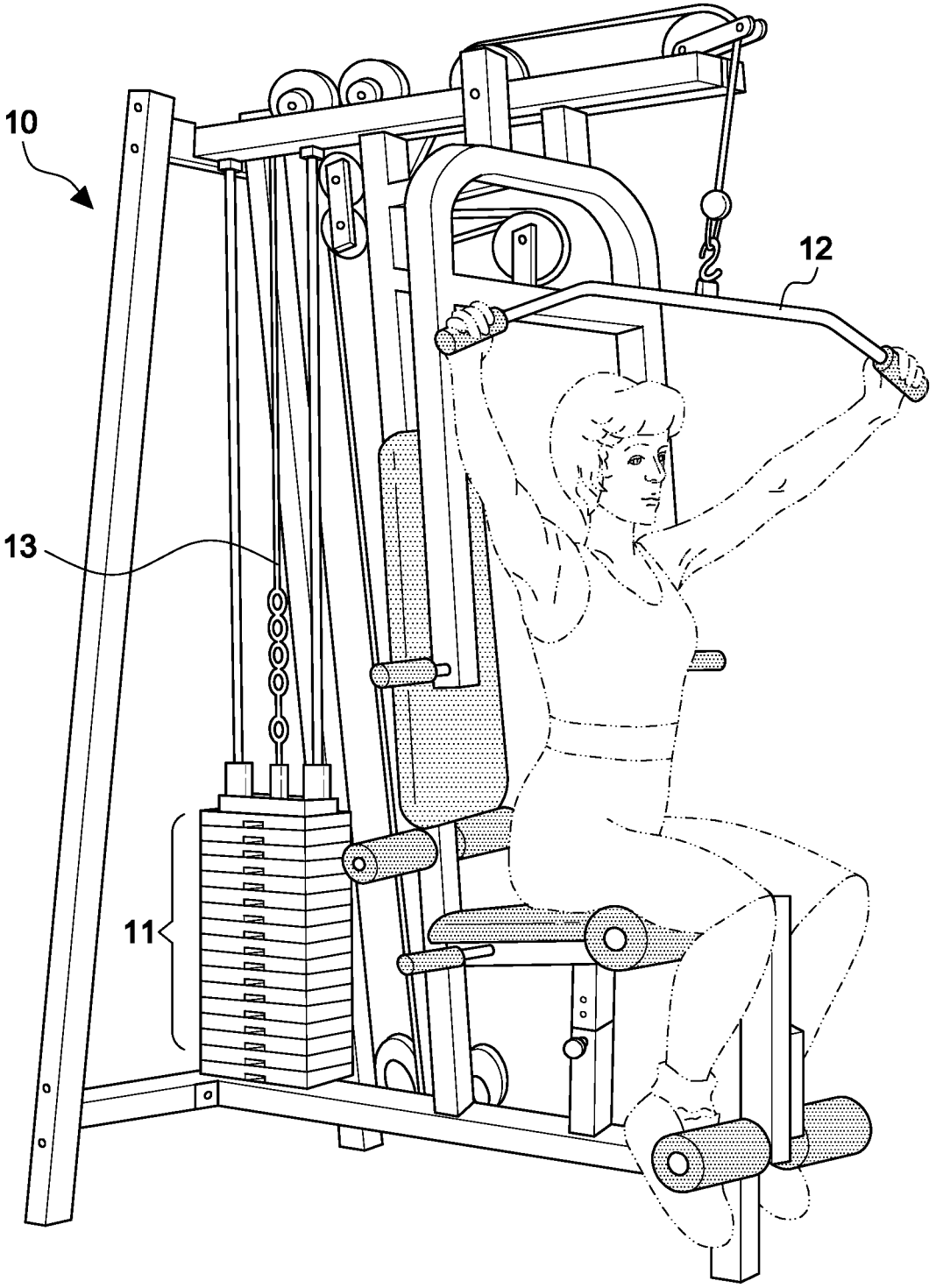
FIG.1 PRIOR ART
FIG. 1 is a perspective view of the conventional strength training machine.
Figure 2:
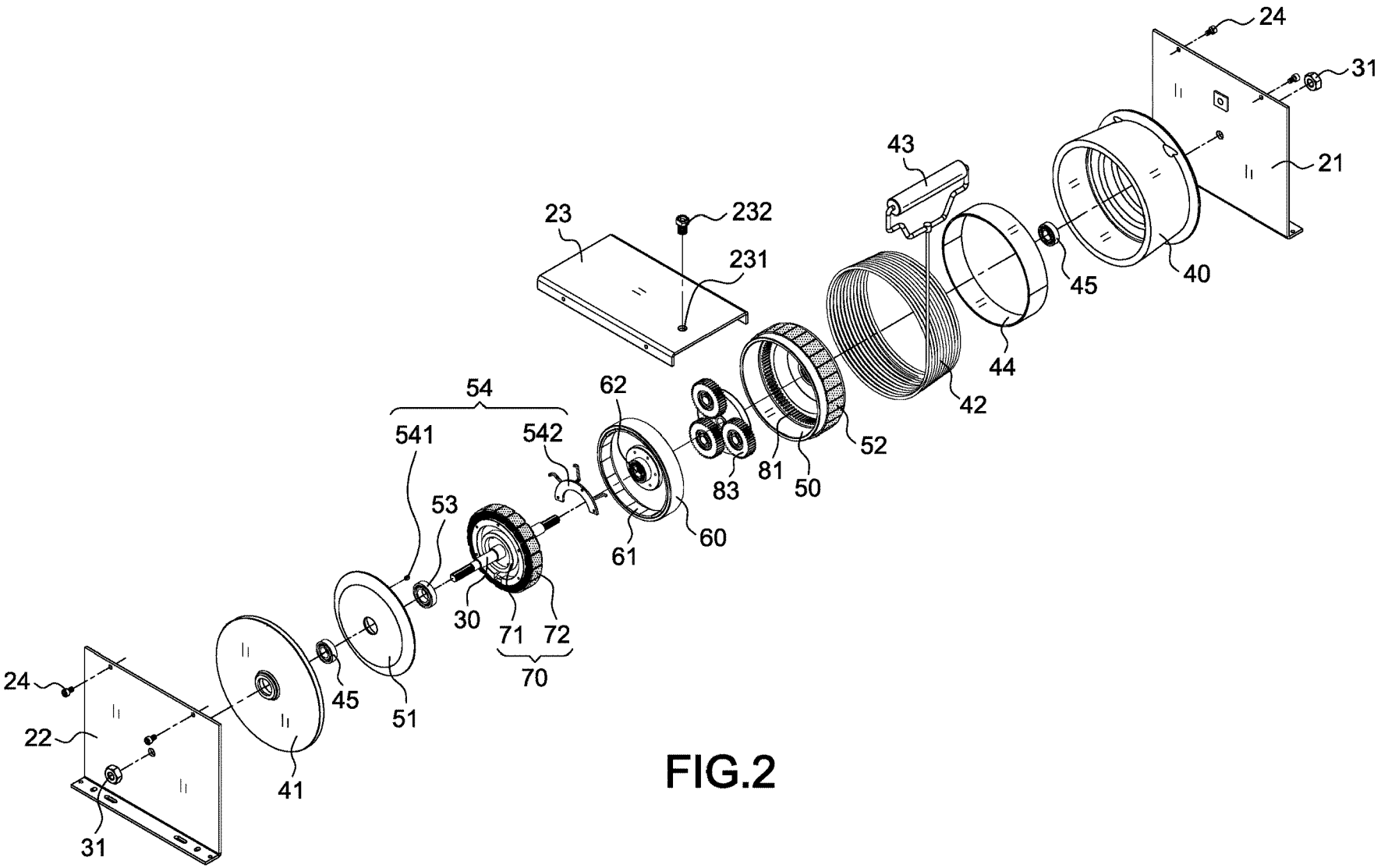
FIG. 2 is an exploded perspective view of the first embodiment of the present invention.
Figure 3:
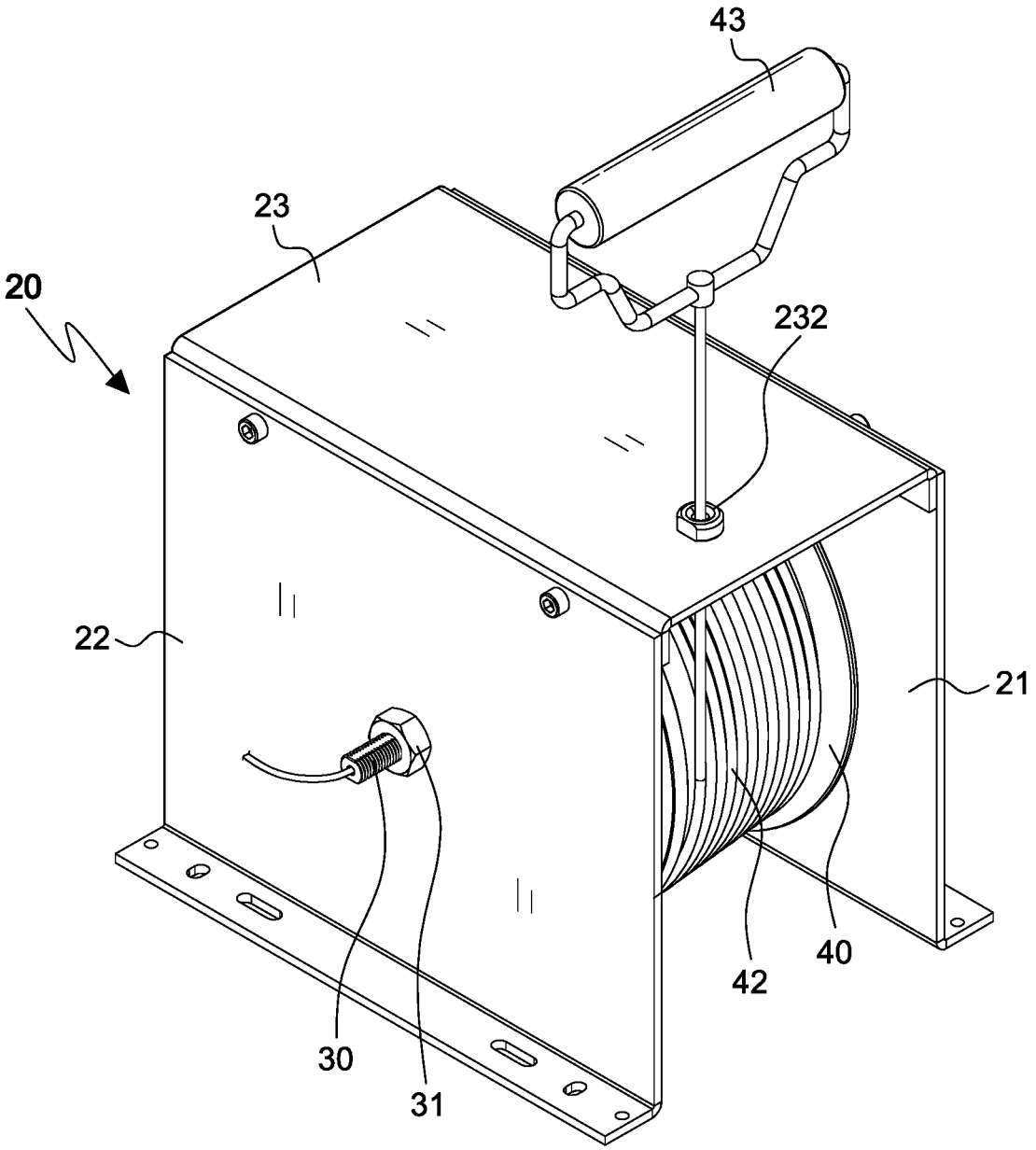
FIG. 3 is a perspective view of the first embodiment of the present invention.
Figure 4:
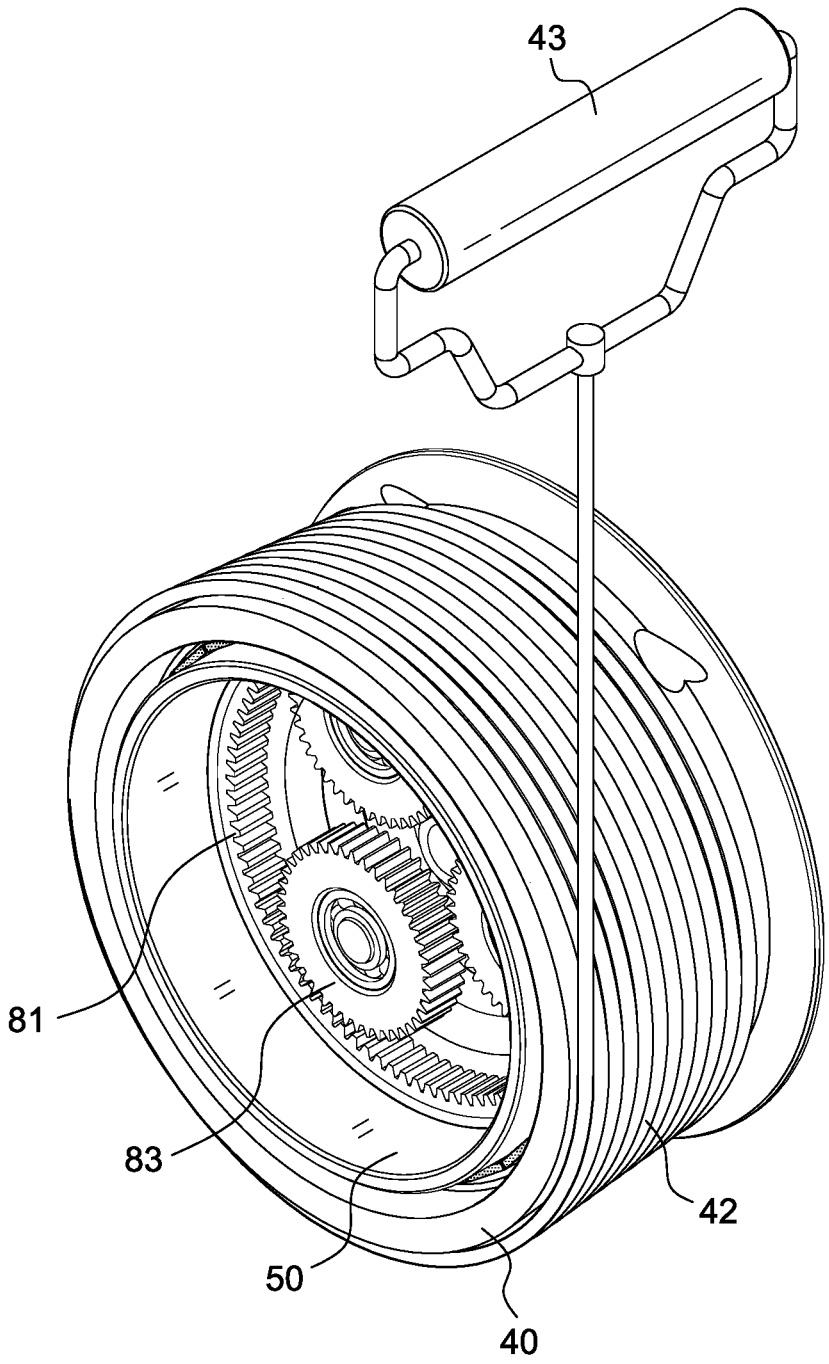
FIG. 4 is a perspective view of the winding wheel and the epicyclic gear set of the first embodiment of the present invention.
Figure 5:
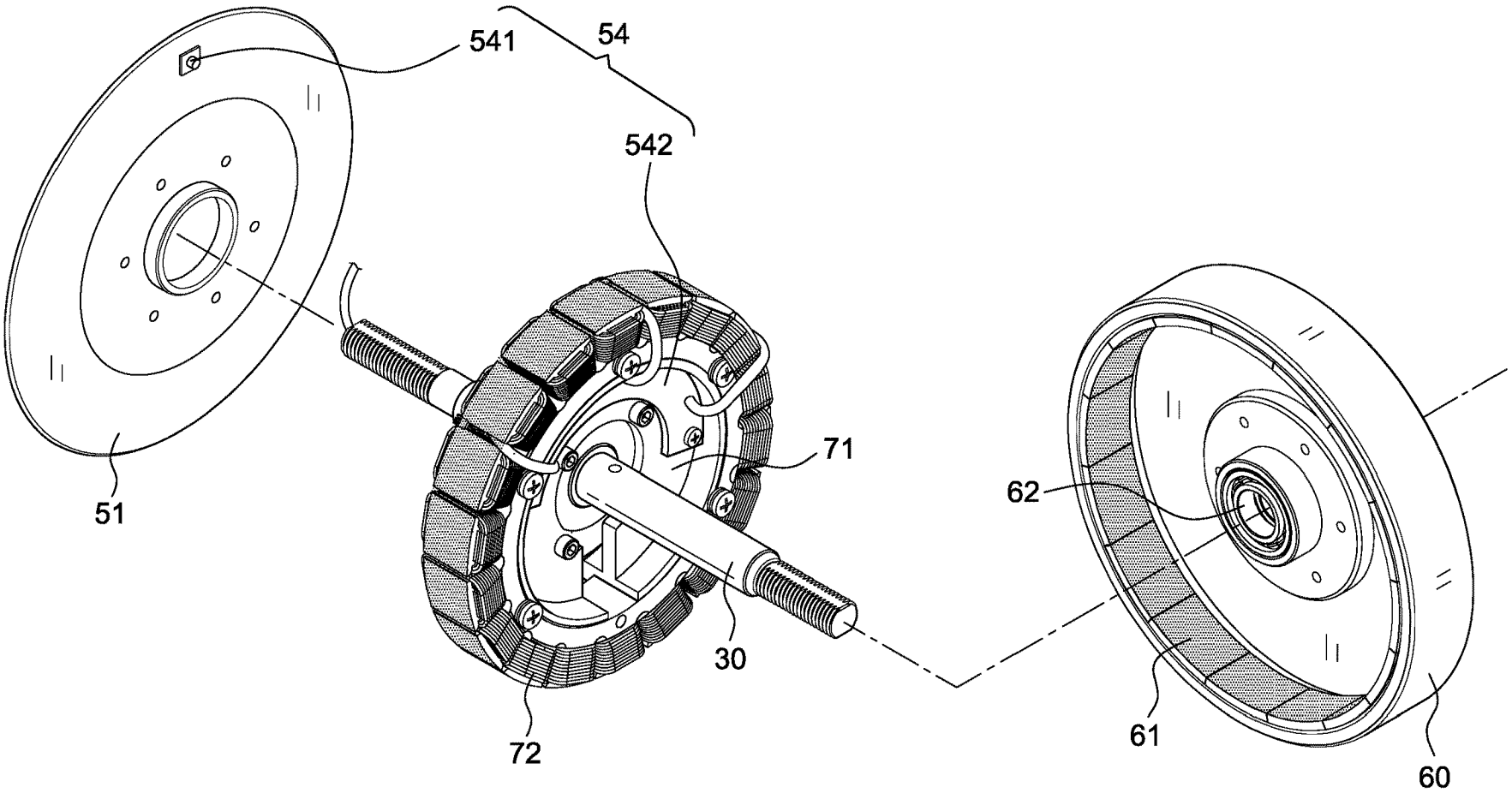
FIG. 5 is a perspective view of the coil set, the inner flywheel and the flywheel cover of the first embodiment of the present invention.
Figure 6:
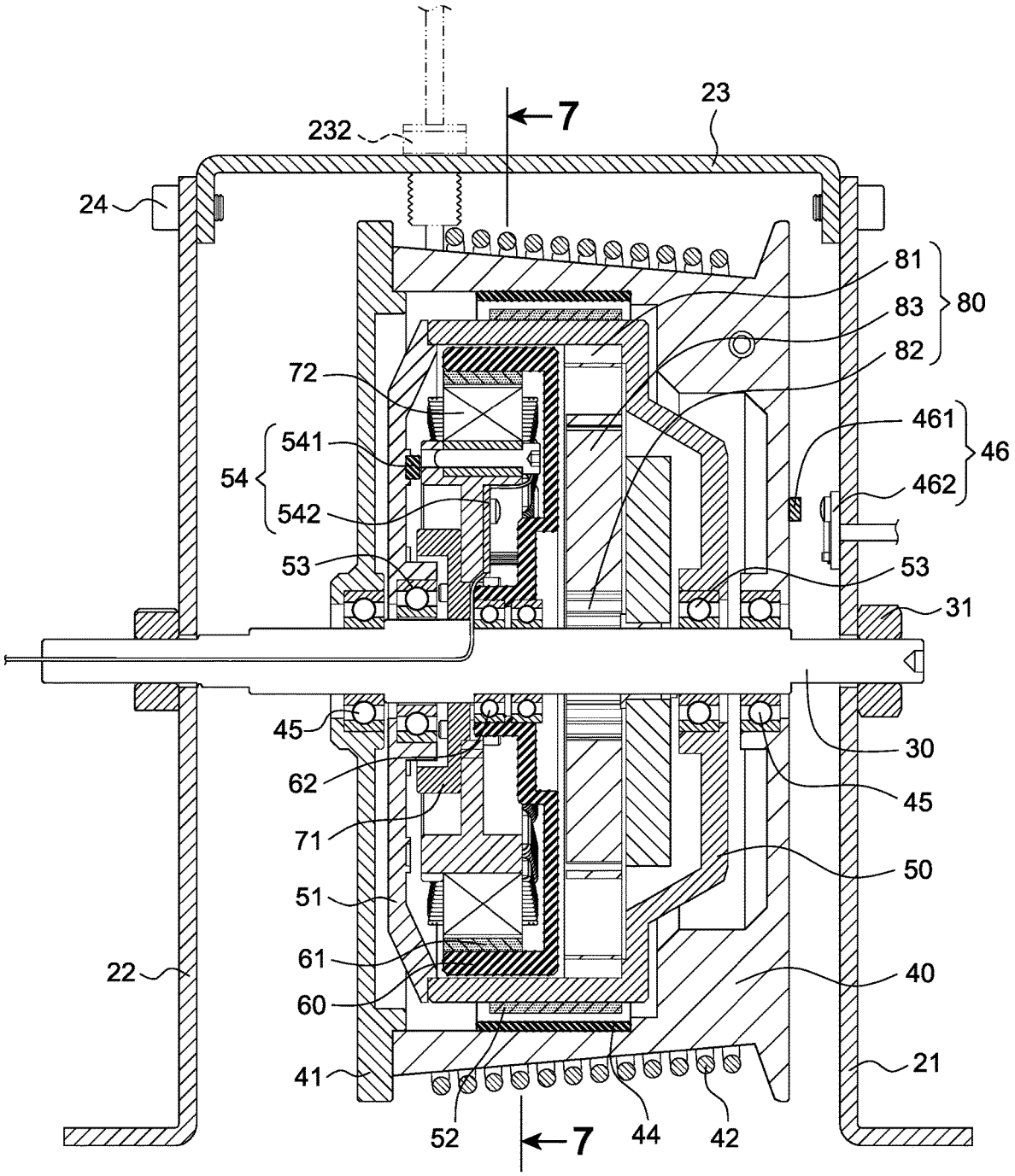
FIG. 6 is a sectional view of the first embodiment of the present invention.
Figure 7:
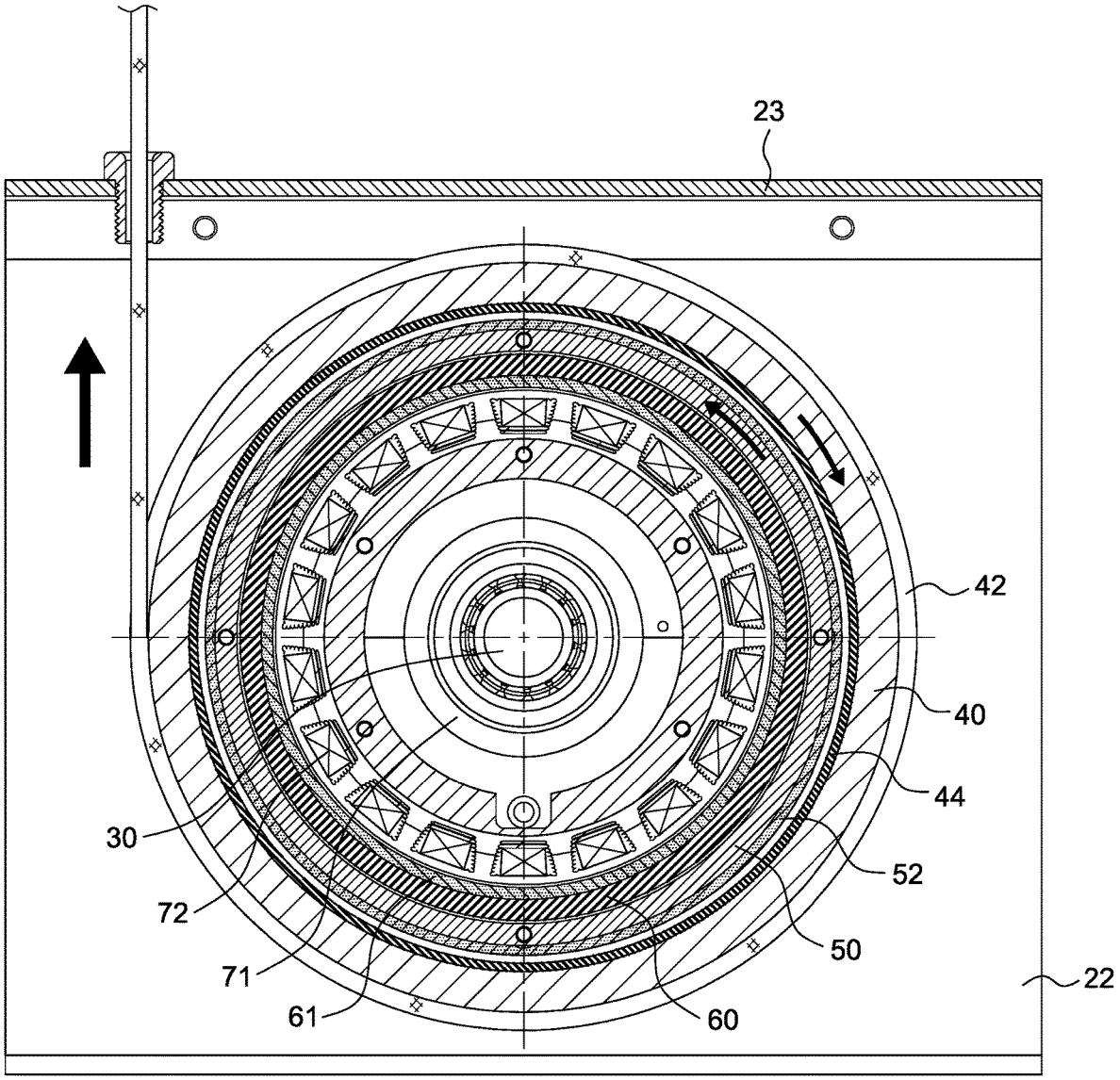
FIG. 7 is a sectional view along line 7-7 in FIG. 6.

Referring to FIGS. 2-7, the present invention includes: a bracket 20, using a positioning unit 24 combines with two side plates 21, 22 and a cover plate 23, the cover plate 23 has a rope guiding hole 231, the rope guiding hole 231 has a rope guiding bushing 232; a shaft center 30 set through the bracket 20, and positioning by a positioning unit 31; a winding wheel 40 set on the shaft center 30 with a wheel cover 41 to form a containing space inside, the winding wheel 40 is winding with a rope 42, the rope 42 set through the rope guiding hole 231 and rope guiding bushing 232 then combines to a grip 43, using a bearing 45 to set the winding wheel 40 and the wheel cover 41 on the shaft center 30, and having a winding wheel spinning encoder 46 relative to winding wheel 40, wherein the winding wheel spinning encoder 46 has a magnet of winding wheel spinning encoder 461 arranged on the winding wheel 40, and the side plates 21, 22 of the bracket 20 have a hall device of winding wheel spinning encoder 462 relative the magnet of winding wheel spinning encoder 461; an outer flywheel 50 set on the shaft center 30 with a flywheel cover 51 to form a containing space inside, the outer flywheel 50 and the flywheel cover 51 are located inside the winding wheel 40, let the winding wheel 40 and the outer flywheel 50 be relatively coupled with a magnetic plate 44 and a magnet 52, the magnetic plate 44 can be a copper sheet, using a bearing 45 to set the outer flywheel 50 and the flywheel cover 51 on the shaft center 30, and an outer flywheel spinning encoder 54 is arranged relative to the outer flywheel 50; the outer flywheel spinning encoder 54 has a magnet of outer flywheel spinning encoder 541 arranged on the flywheel cover 51; an inner flywheel 60 set on the shaft center 30 by a bearing 62 to form a containing space inside, the inner flywheel 60 is arranged inside the outer flywheel 50, and inside the inner flywheel 60 is provide with a field magnet 61; a coil set 70, having a coil fixing frame 71 on the shaft center 30 and arranged inside the inner flywheel 60, having an armature coil 72 arranged on the coil fixing frame 71, and the armature coil 72 is coupled to the field magnet 61 of the inner flywheel 60, the armature coil 72 has an electric current regulator 73, and the armature coil 72 of the coil set 70 have a hall device of outer flywheel spinning encoder 542 relative the m magnet of outer flywheel spinning encoder 541; an epicyclic gear set 80, a ring gear 81 is arranged inside the outer flywheel 50, and a sun gear 82 is arranged outside the inner flywheel 60, and multiple epicyclic gears 83 are arranged between the ring gear 81 and the sun gear 82; and a control system 90, receiving a winding wheel spinning data from the winding wheel spinning encoder 46 and receiving an outer flywheel spinning data from the outer flywheel spinning encoder 54, and then sending an armature electric current control data to the electric current regulator 73.

Figure 8:
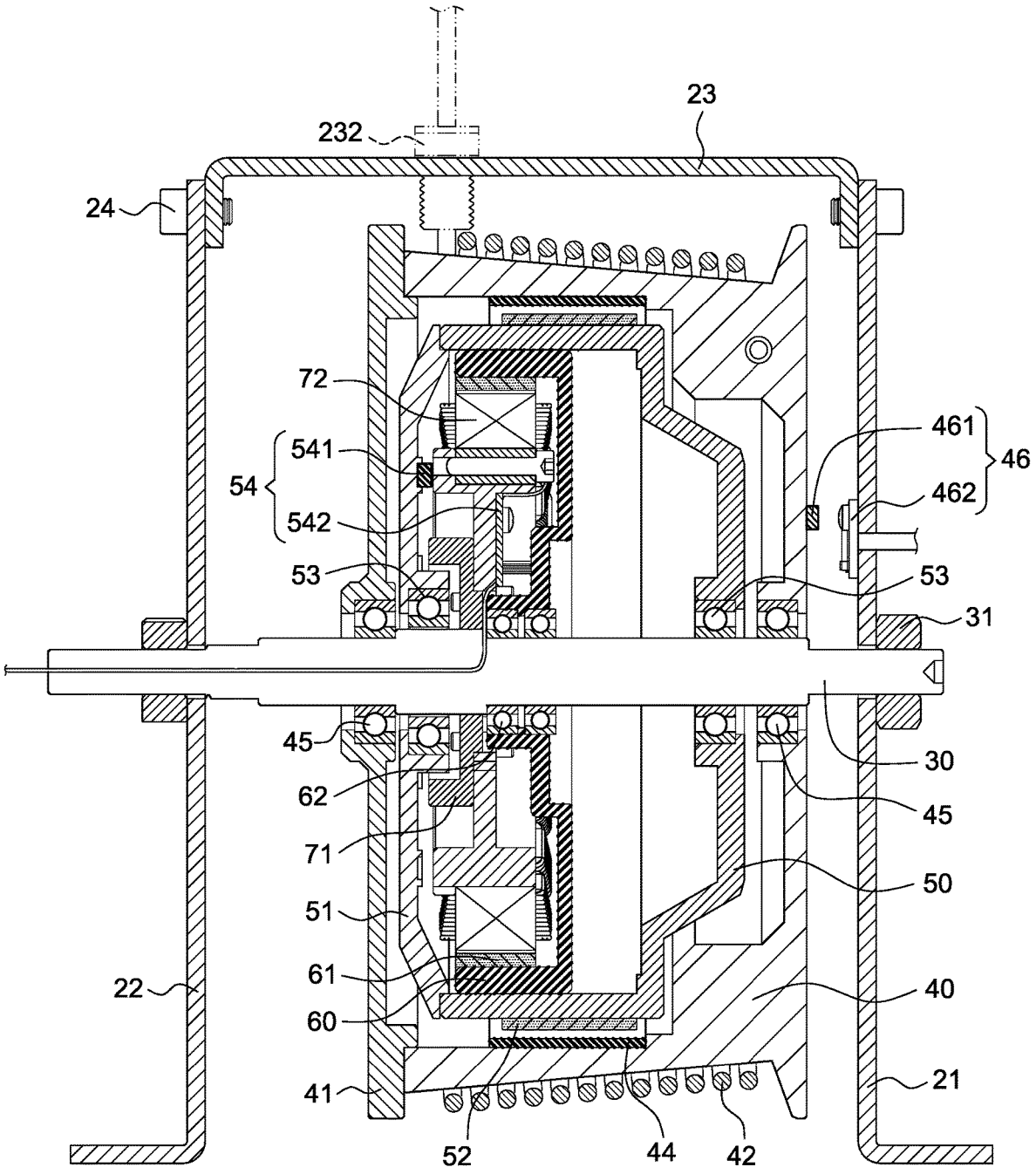
FIG. 8 is a sectional view of the second embodiment of the present invention.

Referring to FIG. 8, the differences between first and second embodiments is: The second embodiment does not has an epicyclic gear set 80 for making the outer flywheel 50 and the inner flywheel 60 using tight fit to transmit torque.

Figure 9:
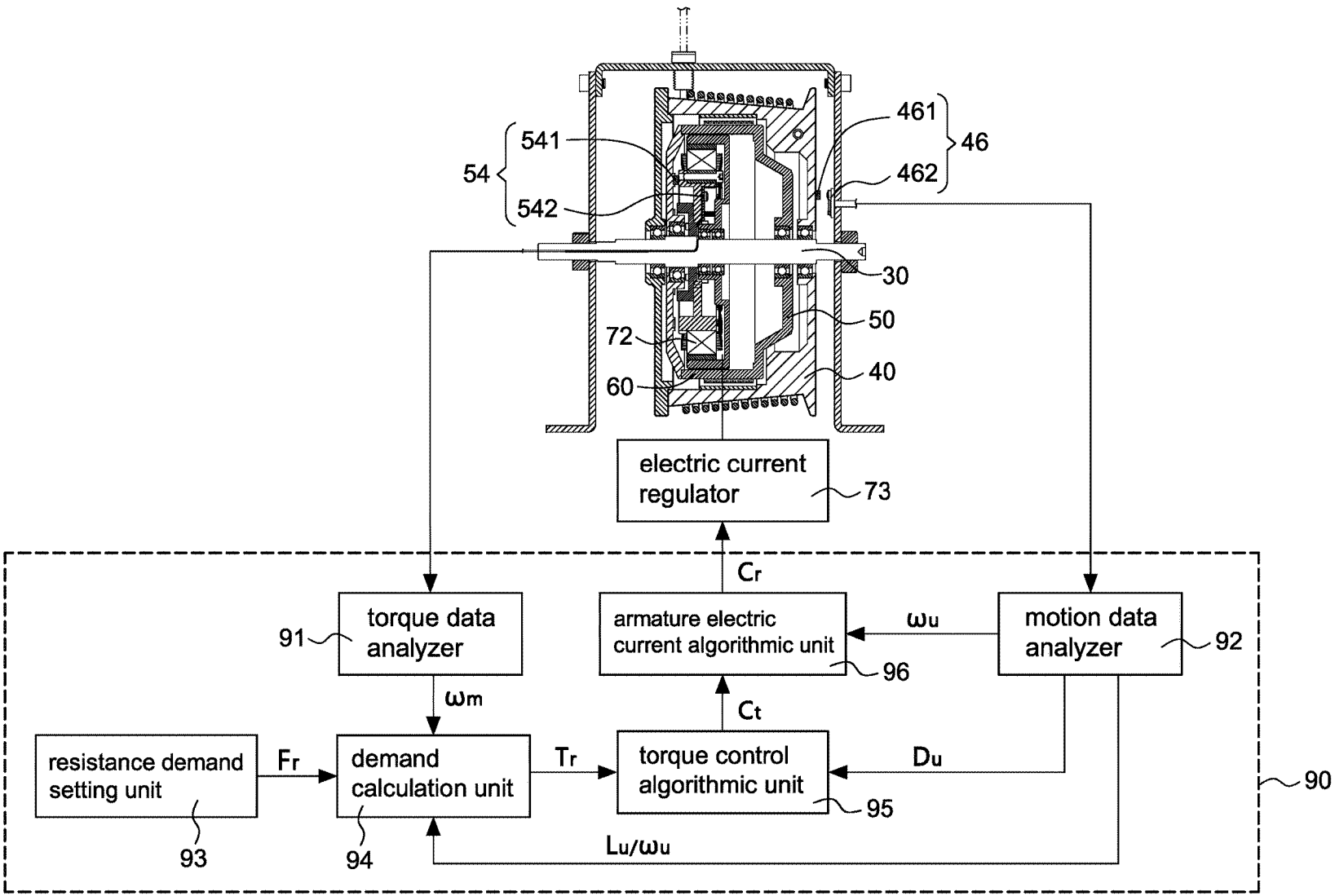
FIG. 9 is a block diagram of the control system of the present invention.

Referring to FIG. 9, the control system 90 has a torque data analyzer 91, a motion data analyzer 92, a resistance demand setting unit 93, a torque demand calculation unit 94, a torque control algorithmic unit 95 and an armature electric current algorithmic unit 96; the torque data analyzer 91 receives the outer flywheel spinning data from the outer flywheel spinning encoder 54, and analyzes out an outer flywheel rotational speed data ωm; the motion data analyzer 92 receives the winding wheel spinning data from the winding wheel spinning encoder 46, and analyzes out a winding wheel steering data Du, a winding wheel rotational speed data ωu and the rope pulling length data Lu; the torque demand calculation unit 94 receives the outer flywheel rotational speed data or ωm from the torque data analyzer 91, the winding wheel rotational speed data ωu and the rope pulling length data Lu from the motion data analyzer 92, and a resistance demand data Fr input by the resistance demand setting unit 93 are added to calculate a torque demand data Tr; the torque control algorithmic unit 95 receives the winding wheel steering data Du from the motion data analyzer 92 and then calculates with the torque demand data Tr from the torque demand calculation unit 94 to get a target electric current data Ct; the armature electric current algorithmic unit 96 receives the winding wheel rotational speed data ωu from the motion data analyzer 92 and then calculates with the target electric current data Ct from the torque control algorithmic unit 95 to get an armature electric current data Cr; the electric current regulator 73 receives the armature electric current data Cr from the armature electric current algorithmic unit 96 to generate a armature electric current control data, so as to control the electric current of the armature coil.

With the features disclosed above, the present invention uses the coil set 70 and the inner flywheel 60 to cause the outer flywheel 50 to generate a torque. When the rope 42 of the winding wheel 40 is pulled outward, the torque can be transmitted from the outer flywheel 50 to the winding wheel 40 through the coupled magnetic plate 44 and magnet 52, and then simulated as motion resistance, so as to control the electric current of the armature coil 72 and further adjust the motion resistance; referring to FIG. 7, the winding wheel 40 and the outer flywheel 50 form a dual-rotor non-contact torque transmission structure, when the rope 42 of the winding wheel 40 is pulled outward, the outer flywheel 50 and the winding wheel 40 rotate in opposite directions, and the outer flywheel 50 forms motion resistance to the winding wheel 40 through the coupled magnetic plate 44 and magnet 52; when the rope 42 of the winding wheel 40 is not applied with any force, the outer flywheel 50 drives the winding wheel 40 to rotate in the same direction through the coupled magnetic plate 44 and magnet 52, and then rewinds the rope 42 of the winding wheel 40; therefore, the present invention has the effect of simulating the motion resistance by controlling the armature electric current.

What is claimed is:

1. A smart torque simulation device, comprising:

a bracket;

a shaft center set through the bracket;

a winding wheel set on the shaft center with a wheel cover to form a containing space inside, the winding wheel is winding with a rope, and having a winding wheel spinning encoder relative to winding wheel;

an outer flywheel set on the shaft center with a flywheel cover to form a containing space inside, the outer flywheel and the flywheel cover are located inside the winding wheel, let the winding wheel and the outer flywheel be relatively coupled with a magnetic plate and a magnet, and an outer flywheel spinning encoder is arranged relative to the outer flywheel;

an inner flywheel set on the shaft center to form a containing space inside, the inner flywheel is arranged inside the outer flywheel, the inner flywheel has a power transmission relationship with the outer flywheel, and inside the inner flywheel is provide with a field magnet;

a coil set, having a coil fixing frame on the shaft center and arranged inside the inner flywheel, having an armature coil arranged on the coil fixing frame, and the armature coil is coupled to the field magnet of the inner flywheel, the armature coil has an electric current regulator; and a control system, receiving a winding wheel spinning data from the winding wheel spinning encoder and receiving an outer flywheel spinning data from the outer flywheel spinning encoder, and then sending an armature electric current control data to the electric current regulator; wherein the control system has a torque data analyzer, a motion data analyzer, a resistance demand setting unit, a torque demand calculation unit, a torque control algorithmic unit and an armature electric current algorithmic unit; the torque data analyzer receives the outer flywheel spinning data from the outer flywheel spinning encoder, and analyzes out an outer flywheel rotational speed data; the motion data analyzer receives the winding wheel spinning data from the winding wheel spinning encoder, and analyzes out a winding wheel steering data, a winding wheel rotational speed data and the rope pulling length data; the torque demand calculation unit receives the outer flywheel rotational speed data from the torque data analyzer, the winding wheel rotational speed data and the rope pulling length data from the motion data analyzer, and a resistance demand data input by the resistance demand setting unit are added to calculate a torque demand data; the torque control algorithmic unit receives the winding wheel steering data from the motion data analyzer and then calculates with the torque demand data from the torque demand calculation unit to get a target electric current data; the armature electric current algorithmic unit receives the winding wheel rotational speed data from the motion data analyzer and then calculates with the target electric current data from the torque control algorithmic unit to get an armature electric current data; the electric current regulator receives the armature electric current data from the armature electric current algorithmic unit to generate an armature electric current control data, so as to control the electric current of the armature coil.

2. The smart torque simulation device as claimed in claim 1, wherein the power transmission relationship between the inner flywheel and the outer flywheel is achieved through an epicyclic gear set, a ring gear is arranged inside the outer flywheel, and a sun gear is arranged outside the inner flywheel, and multiple epicyclic gears are arranged between the ring gear and the sun gear; or the power transmission relationship between the inner flywheel and the outer flywheel is achieved through the tight fit between the inner flywheel and the outer flywheel.

3. The smart torque simulation device as claimed in claim 1, wherein the bracket combines with two side plates and a cover plate, the cover plate has a rope guiding hole, the rope guiding hole has a rope guiding bushing, the rope set through the rope guiding hole and rope guiding bushing then combines to a grip, the magnetic plate is a copper sheet.

4. The smart torque simulation device as claimed in claim 2, wherein the winding wheel spinning encoder has a magnet of winding wheel spinning encoder arranged on the winding wheel, and the side plates of the bracket have a hall device of winding wheel spinning encoder relative the magnet of winding wheel spinning encoder; the outer flywheel spinning encoder has a magnet of outer flywheel spinning encoder arranged on the flywheel cover, and the armature coil of the coil set have a hall device of outer flywheel spinning encoder relative the m magnet of outer flywheel spinning encoder.

* * * * *